US007923184B2

(12) United States Patent
Weiss et al.

(10) Patent No.: US 7,923,184 B2
(45) Date of Patent: Apr. 12, 2011

(54) PHOTOCONDUCTORS CONTAINING TRIMELLITIMIDE ESTERS

(75) Inventors: David S. Weiss, Rochester, NY (US); William T. Gruenbaum, Rochester, NY (US); John C. Wilson, East Aurora, NY (US)

(73) Assignee: Eastman Kodak Company, Rochester, NY (US)

( * ) Notice: Subject to any disclaimer, the term of this patent is extended or adjusted under 35 U.S.C. 154(b) by 791 days.

(21) Appl. No.: 11/862,430

(22) Filed: Sep. 27, 2007

(65) Prior Publication Data

US 2009/0087762 A1 Apr. 2, 2009

(51) Int. Cl.
*G03G 5/047* (2006.01)

(52) U.S. Cl. ..... 430/58.25; 430/58.5

(58) Field of Classification Search ..... 430/58.25, 430/58.5, 78, 83
See application file for complete search history.

(56) References Cited

U.S. PATENT DOCUMENTS

| | | | | |
|---|---|---|---|---|
| 4,578,334 | A | 3/1986 | Borsenberger et al. | |
| 4,666,802 | A | 5/1987 | Hung et al. | |
| 4,701,396 | A | 10/1987 | Hung et al. | |
| 4,719,163 | A | 1/1988 | Staudenmayer et al. | |
| 5,380,613 | A * | 1/1995 | Ueda et al. | 430/58.35 |

FOREIGN PATENT DOCUMENTS

JP 08-202055 A * 8/1996

OTHER PUBLICATIONS

Japanese Patent Office machine-assisted translation of JP-08-202055 (pub. Aug. 1996).*
Weast, R.C., et al., ed., CRC Handbook of Chemistry and Physics, 48th edition, Chemical Rubber Co., OH (1967), p. C-475.*

* cited by examiner

*Primary Examiner* — Janis L Dote
(74) *Attorney, Agent, or Firm* — Carl F. Ruoff; Andrew J. Anderson

(57) ABSTRACT

The present invention is an electrophotographic photoconductor having a photosensitive layer on a conductive substrate. The photosensitive layer contains trimellitimide esters additives.

3 Claims, 4 Drawing Sheets

PHOTOCONDUCTORS CONTAINING TRIMELLITIMIDE ESTERS

CROSS-REFERENCE TO RELATED APPLICATIONS

This application relates to commonly assigned applications Ser. Nos. 11/862,462 (US Publication No. 2009/0087763) and 11/862,493 (US Publication No. 2009/0087764), filed simultaneously herewith and hereby incorporated by reference for all that they disclose.

FIELD OF THE INVENTION

This invention relates to an electrophotographic photoconductor. More specifically, the invention relates to an electrophotographic photoconductor for use in a printer, a copier, or a facsimile of the electrophotographic type having a photosensitive layer containing an organic material on a conductive substrate.

BACKGROUND OF THE INVENTION

In electrophotography an image comprising a pattern of electrostatic potential (also referred to as an electrostatic latent image), is formed on a surface of an electrophotographic element comprising at least an insulative photoconductive layer and an electrically conductive substrate. The electrostatic latent image is usually formed by imagewise radiation-induced discharge of a uniform potential previously formed on the surface. Typically, the electrostatic latent image is then developed into a toner image by bringing an electrographic developer into contact with the latent image. If desired, the latent image can be transferred to another surface before development.

In latent image formation the imagewise discharge is brought about by the radiation-induced creation of electron/hole pairs, which are generated by a material (often referred to as a charge-generation material) in the electrophotographic element in response to exposure to the imagewise actinic radiation. Depending upon the polarity of the initially uniform electrostatic potential and the types of materials included in the electrophotographic element, either the holes or the electrons that have been generated migrate toward the charged surface of the element in the exposed areas and thereby cause the imagewise discharge of the initial potential. What remains is a non-uniform potential constituting the electrostatic latent image.

Such elements may contain material which facilitates the migration of generated charge toward the oppositely charged surface in imagewise exposed areas in order to cause imagewise discharge. Such material is often referred to as a charge-transport material.

Among the various known types of electrophotographic elements are those generally referred to as multiactive elements (also sometimes called multilayer or multi-active-layer elements). Multiactive elements are so named, because they contain at least two active layers, at least one of which is capable of generating charge in response to exposure to actinic radiation and is referred to as a charge-generation layer (hereinafter sometimes alternatively referred to as a CGL), and at least one of which is capable of accepting and transporting charges generated by the charge-generation layer and is referred to as a charge-transport layer (hereinafter sometimes alternatively referred to as a CTL). Such elements typically comprise at least an electrically conductive layer, a CGL, and a CTL. Either the CGL or the CTL is in electrical contact with both the electrically conductive layer and the remaining CGL or CTL. The CGL comprises at least a charge-generation material; the CTL comprises at least a charge-transport material; and either or both layers may additionally comprise a film-forming polymeric binder.

Among the known multiactive electrophotographic elements, are those that are particularly designed to be reusable and to be sensitive to imagewise exposing radiation falling within the visible and/or infrared regions of the electromagnetic spectrum. Reusable elements are those that can be practically utilized through a plurality (preferably a large number) of cycles of uniform charging, imagewise exposing, optional development and/or transfer of electrostatic latent image or toner image, and erasure of remaining charge, without unacceptable changes in their performance. Visible and/or infrared radiation-sensitive elements are those that contain a charge-generation material that generates charge in response to exposure to visible and/or infrared radiation. Many such elements are well known in the art.

For example, some reusable multiactive electrophotographic elements that are designed to be sensitive to visible radiation are described in U.S. Pat. Nos. 4,578,334 and 4,719,163, and some reusable multiactive electrophotographic elements which are designed to be sensitive to infrared radiation are described in U.S. Pat. Nos. 4,666,802 and 4,701,396.

A problem can occur when the CTL has been adventitiously exposed to blue and/or ultraviolet radiation (i.e., radiation of a wavelength less than about 500 nanometers, which, for example, forms a significant portion of the radiation emitted by typical fluorescent room lighting). This can occur, for example, when the electrophotographic element is incorporated in a copier apparatus and is exposed to typical room illumination during maintenance or repair of the copier's internal components. The problem is manifested as a buildup of residual potential within the electrophotographic element over time as the element is exercised through its normal cycles of electrophotographic operation after having been adventitiously exposed to blue and/or ultraviolet radiation.

For example, in normal cycles of operation such an element might be initially uniformly charged to a potential of about −500 volts, and it might be intended that the element should then discharge, in areas of maximum exposure to normal imagewise actinic visible or infrared exposing radiation, to a potential of about −100 volts, in order to form the intended electrostatic latent image. However, if the electrophotographic element has been adventitiously exposed to blue and/or ultraviolet radiation, there will be a buildup of residual potential that will not be erased by normal methods of erasing residual charge during normal electrophotographic operation. For example, after about 500 cycles of operation, the unerasable residual potential may be as much as −200 to −300 volts, and the element will no longer be capable of being discharged to the desired −100 volts. This results in a latent image being formed during normal operation, which constitutes an inaccurate record of the image intended to be represented. In effect, the element has become no longer reusable, after only 500 cycles of operation.

It is known that all charge transporting materials absorb blue and/or ultraviolet light. Some charge transporting materials such as tri-p-tolylamine (TTA), absorb light and undergo a photochemical reaction. TTA in a CTL with bisphenol-A polycarbonate binder strongly absorbs ultraviolet light and the subsequent TTA photochemical reaction causes a buildup of residual potential with electrophotographic cycling as described above.

It is an object of the present invention to provide an electrophotographic photoconductor improved in stability to exposure to blue and/or ultraviolet light by using an additive hitherto unknown for addition to electrophotographic photoconductors.

SUMMARY OF THE INVENTION

The present invention is an electrophotographic photoconductor having a photosensitive layer on a conductive substrate. The photosensitive layer includes a layer containing additives of trimellitimide esters.

Figure 1:
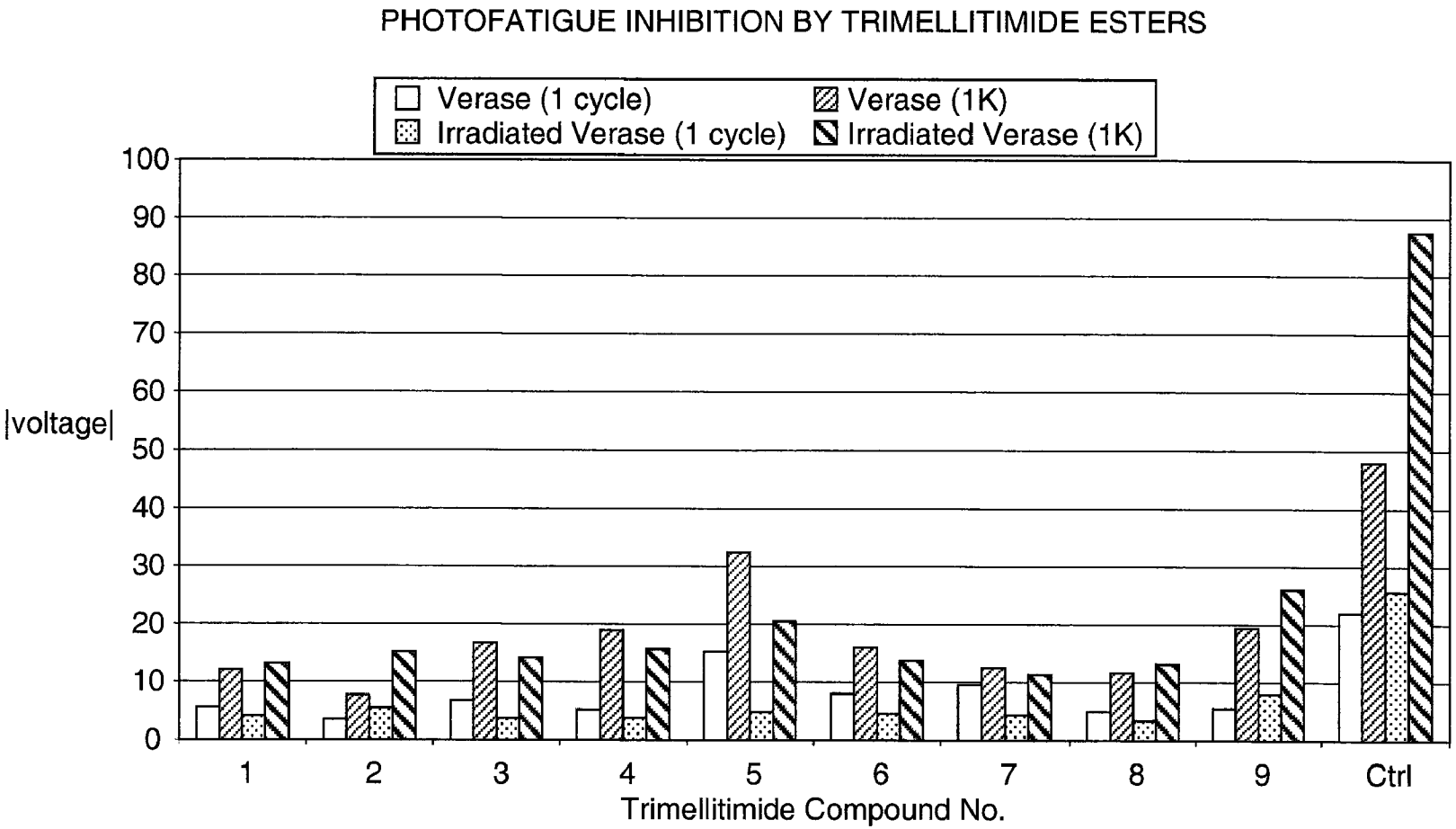
FIG. 1 shows 1,000 cycle photofatigue inhibition data for OPC films with a trimellitimide ester in the CTL.

For a better understanding of the present invention together with other advantages and capabilities thereof, reference is made to the following description and appended claims in connection with the preceding drawings.

DETAILED DESCRIPTION OF THE INVENTION

In the electrophotographic process the organic photoconductor (OPC) film obtains a surface charge (typically from a corona charging device or charging roller). The surface charge and opposing grounded surface place an electric field across the OPC.

OPCs comprise materials that absorb light from the writing system and generate charge and materials which transport the generated charge to either the grounded surface or the free surface to neutralize the electric field. Positive charge (holes) moves towards the negative surface and negative charge (electrons) moves towards the positive surface.

OPCs can be fabricated as "single layer" in which the charge generation materials (CGMs) and charge transport materials (CTMs) are combined in a single layer, or "dual layer" in which one layer has charge generation (CGL) as its primary function and one layer has charge transport (CTL) as its primary function. In many cases the CGL also contains CTMs to facilitate transport of holes and electrons from the site of charge generation. This is particularly necessary if the CGL is relatively thick (greater than ~1 micron or so). The CTL is typically relatively thick (on the order of 25 microns or so) and contains a CTM or mixture of CTMs that transport only positive charge (holes). Thus, the bulk of the photodischarge in a dual layer OPC occurs by transport of positive charge through the CTL to the free surface that is negatively charged.

Since hole transport through the CTL of a "dual layer" OPC is where the bulk of the photodischarge occurs it is important that the transport characteristics of this layer remain constant with electrophotographic cycling. Sometimes it is observed that an OPC will have an undesirable change in characteristics such as increased dark decay (decrease in surface potential in non-exposed areas of the OPC) or increased residual potential (less than complete photodischarge in exposed areas of the OPC). OPCs with undesirable changes in characteristics such as these are said to be "fatigued". There are several mechanisms by which such fatigue can occur. One cause of OPC fatigue is observed to be due to the absorption of light by the CTMs leading to photochemical reactions. Hole CTMs are typically designed such that they do not absorb light from the exposure system since this would prevent light from reaching the underlying CGM (for front exposure systems). In practice, hole CTMs always absorb ultraviolet light and sometimes visible light depending on their chemical structure. An OPC might be exposed to light absorbed by the CTMs during the loading process or during machine repair, or there may be light emitting sensors present in the machine for various process control functions. Office fluorescent lighting is a significant source of blue and ultraviolet light and we have observed that even brief exposures of an OPC to office lighting can result in degraded performance "fatigue" in subsequent electrophotographic cycling.

For example, we have found that a typical triarylamine CTM, tri-p-tolylamine, when formulated as a CTL with bisphenol-A polycarbonate binder polymer undergoes a chemical reaction that leads to the photochemical conversion to give a new material. In other words, the excited state of the CTM undergoes a photochemical reaction. The loss of CTM where the ultraviolet light has been absorbed (near the OPC surface) produces a region in the CTL where hole transport is poor because the CTM concentration is low. This causes an increasing residual potential with electrophotographic cycling and decreases the useful lifetime of the OPC.

We have also found that certain CTL additives can prevent this undesirable photochemistry from occurring. These materials act by forming a ground state donor-acceptor charge transfer complex with the hole transporting CTM. The charge transfer complex is evident by a change in absorption characteristics of the CTL with enhanced absorption at wavelengths longer than the lowest energy CTM absorption. Since the hole CTMs are "donor" molecules the preferred additives are "acceptor" molecules. Our mechanistic understanding is that the ground state charge transfer complex serves as an energy "sink" such that the energy imparted to the CTM due to the absorption of light is funneled to charge transfer sites in the CTL where it is dissipated as emitted light and/or heat (radiationless decay). The energy of the excited state CTM can move a considerable distance in the CTL until it finds the lower energy charge transfer site where it becomes localized. Thus, the additive can be effective at stabilizing the CTL to CTM light absorption even at relatively low concentrations. This is desirable because at high concentrations the additive might, by its presence, cause undesirable changes in OPC characteristics.

The absorption wavelength of the ground state charge transfer complex between CTM donor and acceptor depends upon the energy difference between the two materials (oxidation potential of the donor and reduction potential of the acceptor). For a particular donor molecule the charge transfer absorption will shift to longer wavelength (lower energy) as the reduction potential of the acceptor decreases. Thus, the acceptor additive should have a reduction potential which is not so high that a charge transfer complex doesn't form, nor so low that the charge transfer absorption overlaps with the imaging exposure.

Electrically conducting supports include, for example, paper (at a relative humidity above 20 percent); aluminum-paper laminates; metal foils such as aluminum foil, zinc foil, etc.; metal plates, such as aluminum, copper, zinc, brass and galvanized plates; metal drums and sleeves, such as aluminum, nickel, etc.; vapor deposited metal layers such as silver, chromium, nickel, aluminum and the like coated on paper or conventional photographic film bases such as cellulose acetate, polystyrene, poly(ethylene terephthalate), etc. Such conducting materials as chromium, nickel, etc., can be vacuum deposited on transparent film supports in sufficiently thin layers to allow electrophotographic elements prepared therewith to be exposed from either side of such elements.

The charge generation layer is generally made up of a charge generation material dispersed in an electrically insulating polymeric binder. The charge generation layer may also be vacuum deposited, in which case no polymer is used. Optically, various sensitizing materials such as spectral sensitizing dyes and chemical sensitizers may also be incorporated in the charge generation layer. Examples of charge generation material include many of the photoconductors used as charge transport materials in charge transport layers. Particularly useful photoconductors include titanyl tetrafluorophthalocyanine, described in U.S. Pat. No. 4,701,396, bromoindium phthalocyanine, described in U.S. Pat. No. 4,666, 802 and U.S. Pat. No. 4,427,139, the dye-polymer aggregate described in U.S. Pat. Nos. 3,615,374 and 4,175,960, and perylenes or selenium particles described in U.S. Pat. No. 4,668,600 and U.S. Pat. No. 4,971,873. An especially useful charge generation layer comprises a layer of heterogeneous or aggregate composition as described in Light, U.S. Pat. No. 3,615,414 issued Oct. 26, 1971.

A charge transport layer is applied over the charge generation layer. Typically, the charge transport layer has a thickness in the range of about 5 to about 25 microns and can contain any organic or inorganic charge transport agent. Most charge transport agents preferentially accept and transport either positive charges (holes) or negative charges (electrons), although materials are known which will transport both positive and negative charges. Those exhibiting a preference for conduction of positive charge carriers are called p-type transport materials, and those exhibiting a preference for the conduction for negative charges are called n-type transport agents. Various p-type organic compounds can be used in the charge-transport layer such as:

1. Carbazoles including carbazole, N-ethyl carbazole, N-isopropyl carbazole, N-phenyl carbazole, halogenated carbazoles, various polymeric carbazole materials such as poly (vinyl carbazole), halogenated poly(vinyl carbazole), and the like.

2. Arylamines including monoarylamines, diarylamines, triarylamines and polymeric arylamines. Specific arylamine organic photoconductors include the nonpolymeric triphenylamines illustrated in U.S. Pat. No. 3,180,730; the polymeric triarylamines described in U.S. Pat. No. 3,240,597; the triarylamines having at least one aryl radical substituted by either a vinyl radical or a vinylene radical having at least one active hydrogen-containing group, as described in U.S. Pat. No. 3,567,450; the triarylamines in which at least one aryl radical is substituted by an active hydrogen-containing group, as described by U.S. Pat. No. 3,658,520; and tritolylamine.

3. Polyarylalkanes of the type described in U.S. Pat. Nos. 3,274,000; 3,542,547; and 3,615,402. Preferred polyarylalkane photoconductors are of the formula:

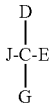

wherein:

D and G, which may be the same or different, each represent an aryl group and J and E, which may be the same or different, each represent a hydrogen atom, an alkyl group, or an aryl group, and at least one of D, E and G contain an amino substituent. An especially useful charge-transport material is a polyarylalkane wherein J and E represent hydrogen, aryl or alkyl, and D and G represent a substituted aryl group having as a substituent thereof a group of the formula:

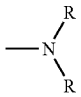

wherein:

R is an unsubstituted aryl group such as phenyl or an alkyl-substituted aryl group such as a tolyl group. Examples of such polyarylalkanes may be found in U.S. Pat. No. 4,127,412.

4. Strong Lewis bases such as aromatic compounds, including aromatically unsaturated heterocyclic compounds free from strong electron-withdrawing groups. Examples include tetraphenylpyrene, 1-methylpyrene, perylene, chrysene, anthracene, tetraphene, 2-phenyl naphthalene, azapyrene, fluorene, fluorenone, 1-ethylpyrene, acetyl pyrene, 2,3-benzochrysene, 3,4-benzopyrene, 1,4-bromopyrene, poly (vinyltetracene), poly(vinyl perylene) and poly(vinyl tetraphene).

5. Hydrazones including the dialkyl-substituted aminobenzaldehyde diphenylhydrazones of U.S. Pat. No. 4,150,987; alkylhydrazones and arylhydrazones as described in U.S. Pat. Nos. 4,554,231; 4,487,824; 4,481,271; 4,456,671; 4,446,217; and 4,423,129, which are illustrative of the p-type hydrazones.

Other useful p-type charge transport agents are the p-type photoconductors described in Research Disclosure, Vol. 109, May, 1973, pages 61-67, paragraph IV(A) (2) through (13).

The charge transport agent(s) is/are compounded with a polymeric binder. Preferably, both the charge transport agent and the polymeric binder are dissolved in a carrier liquid. Presently preferred polymeric binders for use in a charge transport layer of the present invention are polycarbonates and polyesters.

Electrophotographic elements of the invention can include various additional layers known to be useful in electrophotographic elements in general, for example, subbing layers, overcoat layers, barrier layers, and screening layers.

We have found that the N-aryl trimellitimide esters are a particularly useful class of photofatigue inhibiting CTL additive. Some examples of this class appear in Table 1.

TABLE 1

Trimellitimide Esters

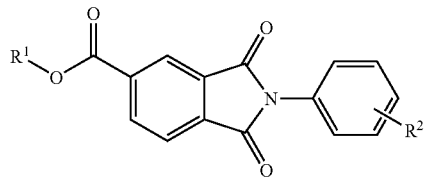

| No. | $R^1$ | $R^2$ |
|---|---|---|
| 1 | $CH_3$ | H |
| 2 | $CH_3$ | m-$CH_3$ |
| 3 | $CH_3$ | p-$CH_3$ |
| 4 | $(CH_3)_2CH$ | p-$CH_3$ |
| 5 | $CH_3(CH_2)_3$ | p-$CH_3$ |
| 6 | $CH_3$ | m-$CO_2CH_3$ |
| 7 | $CH_3$ | p-$CO_2CH_3$ |
| 8 | $CH_3$ | p-Cl |
| 9 | $CH_3$ | p-$NO_2$ |

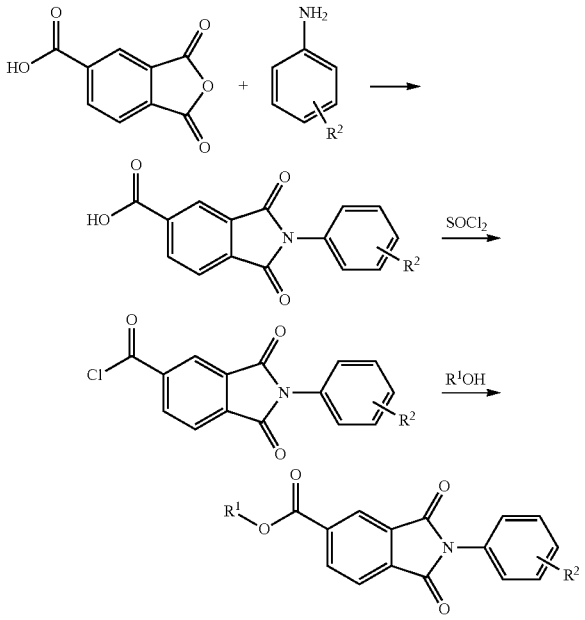

The compounds in Table 1 were synthesized by condensing trimellitic anhydride with a substituted aniline, followed by esterification of the trimellitimide carboxylic acid.

The compounds shown in Table 1 are representative of the class of the photo fatigue inhibiting CTL additive. In the general structure shown above, $R^1$ is alkyl or aryl and $R^2$ is hydrogen, alkyl, alkoxy, aryloxy, aryl, halogen, cyano, carboxylic ester, acyl, perfluoroalkyl, alkylsulfonyl and nitro.

Synthesis Example. Compound 1. An equimolar mixture of trimellitic anhydride (192 g) and aniline (93.1 g) was refluxed in N,N-dimethyformamide (DMF) (800 mL) for 4 hr. The solid which formed on cooling was washed with methanol and recrystallized from acetic acid. The crystalline product was washed with acetone and dried to afford 145 g (54.3%) of N-phenyl-4-carboxyphthalimide, mp 258-260° C.

A mixture of N-phenyltrimellitimide (130 g), thionyl chloride (520 mL) and DMF (2 mL) was refluxed for 4.8 hr, allowed to cool, and concentrated under vacuum with steam heating. The solid residue was slurried in heptane, filtered, washed with ligroine and dried to afford 137 g (98.9%) of N-phenyl-4-chlorocarbonylphthalimide.

A mixture of 137 g of N-phenyl-4-chlorocarbonylphthalimide and methanol (1.37 L) was refluxed for 1 hr. The solid which formed on cooling was collected and dried to afford 128 g (94.7%) of N-phenyl-4-carbomethoxyphthalimide, Compound 1, mp 200-207° C. Recrystallization of 91.3 g from 2 L of acetonitrile yielded 77.8 g (80.7%) of Compound 1, mp 205-207° C.

The trimellitimide compounds useful in the present invention include the following substituent groups in the $R^1$ position, alkyl or aryl, and the following substituent groups in the $R^2$ position, hydrogen, alkyl, alkoxy, aryloxy, aryl, halogen, cyano, carboxylic ester, acyl, perfluoroalkyl, alkylsulfonyl.

The trimellitimide compounds in Table 1 were utilized as photofatigue inhibitors by adding each to the charge transport layer of a multi-layer organic photoreceptor.

Photoreceptor formulation example. The trimellitimides were tested as photofatigue inhibitors by adding them to the CTL of a multi-layer organic photoconductor fabricated as follows: A conducting electrode layer of 0.4 optical density Ni was evaporated on 7-mil thick poly(ethylene terephthalate). A barrier layer of Amilan CM8000 polyamide was coated 0.5 μm thick from 35/65 (wt/wt) dichloromethane/ethanol over the nickel layer. A CGL mixture of 50 wt % 75/25 titanyl phthalocyanine/titanyl tetrafluorophthalocyanine cocrystal, 37.5% poly[1,3 neopentylidene-co-2,2'-oxydiethylene (80/20) isophthalate-co-5-sodiosulfoisophthalate (95/5)], and 12.5% poly(vinyl butyral) was coated 0.4 μm thick from 70/30 dichloromethane/1,1,2-trichloroethane over the barrier layer. A charge transport layer (CTL) containing of 20% tri-p-tolylamine, 20% 1,1-bis(di-p-tolylaminophenyl) cyclohexane, (60−x)% of bisphenol-A polycarbonate, and x % of a trimellitimide ester listed in Table 1 was coated 20 μm thick from DCM solution over the CGL. The upper limit of x was defined by trimellitimide solubility in the CTL solution. All layers were X-hopper coated on a pilot scale apparatus.

In the first set of experimental films, the trimellitimides were added at a constant concentration of 0.20 mol-trimellitimide/kg-CTL solids. The flash photodischarge and 1,000 cycle photo fatigue inhibition data were collected as described below and are listed in Table 2, along with the amount of each trimellitimide added and the CTL thickness measured from 500× cross-section photomicrographs.

Flash Photodischarge. Photodischarge data were obtained by charging the photoreceptor to −500V and exposing through a "transparent" surface voltmeter probe with a xenon flash filtered through a 775 nm dichroic filter. The surface potential as a function of time after exposure was recorded. The charge-expose process was repeated varying the intensity of the exposure with neutral density filters. The surface potential 0.5 sec after the exposing flash was taken to be the Vexpose. A graph of Vexpose vs. log (Exposure) was used to characterize the photoreceptor according to: a photosensitivity parameter, b, dark decay (the seven second decrease in surface potential from −500V in the dark), and a Vresidual parameter, d, described in U.S. Pat. No. 4,708,459.

Photo Fatigue Testing. Electrical-only electrophotographic testing was carried out on an in-house apparatus which has the following sequential process steps: corona charging (−500V surface potential aim), exposure (xenon flash filtered to pass light of wavelength ~600-700 nm and through a neutral density wedge filter to modulate the exposure), erase (exposure of the photoreceptor to the light from an incandescent lamp filtered to pass light of wavelength ~600-700 nm). The apparatus has surface-reading voltmeters to read the surface potential after corona charging, after exposure, and after erase. The photoreceptor was fabricated as a loop (~35 mm wide) with six segments ultrasonically welded. Each segment was a separate test strip and the exposure was modulated such that the exposure varies from one end to the other. Thus, data was obtained for all six samples in a test. In a typical test the electrophotographic cycle was repeated for 1,000 to 10,000 cycles and data collected at preselected cycle numbers. To determine the effect of fluorescent light exposure on the photoreceptor the test loop included two samples from each of three photoreceptors (often one of the photoreceptors acts as the control for the experiment). The samples were welded together to form a strip in the order: Sample 1, Sample 2, Sample 3, Sample 1, Sample 2, Sample 3. Half of the strip (three different samples) was exposed to cool-white fluorescent light (120 foot-candles) for 20 minutes. The remaining three samples were kept in the dark. The loop was then constructed by carrying out the final ultrasonic weld. The sample was then tested in the regeneration apparatus. Thus, using this procedure we simultaneously obtained data on the "normal" cycling characteristic and the "fluorescent-light exposed" cycling characteristic for all three photoreceptor samples. In the current investigation, one of the samples was typically the photoreceptor with a CTL having no additive. From the regeneration apparatus we obtained the following data: Verase (surface potential after the erase exposure), Vblack (surface potential in a non-exposed portion of the sample), and Vexpose (surface potential at five exposure levels).

Table 2 presents the flash photodischarge and 1000 cycle photo fatigue inhibition data for the films containing a constant concentration of trimellitimide ester in the CTL. All nine films exhibited better photo fatigue inhibition than the control, as seen from a comparison of the "Irradiated Verase (1K)" data. The photo fatigue data are presented as a bar graph in FIG. 1.

TABLE 2

Photodischarge and photofatigue inhibition data for trimellitimide esters

| Compound No. | Wt % of CTL | CTL (μm) | b | d | DD (v/sec) | Verase (1 cycle) | Verase (1K) | Irradiated Verase (1 cycle) | Irradiated Verase (1K) |
|---|---|---|---|---|---|---|---|---|---|
| 1 | 5.7 | 20.0 | 0.729 | 0.013 | 4.7 | 5 | 12 | 4 | 13 |
| 2 | 6.0 | 22.2 | 0.740 | 0.003 | 7.3 | 3 | 8 | 5 | 15 |
| 3 | 6.0 | 19.3 | 0.661 | 0.022 | 3.6 | 7 | 17 | 4 | 14 |

TABLE 2-continued

Photodischarge and photofatigue inhibition data for trimellitimide esters

| Compound No. | Wt % of CTL | CTL (μm) | b | d | DD (v/sec) | Verase (1 cycle) | Verase (1K) | Irradiated Verase (1 cycle) | Irradiated Verase (1K) |
|---|---|---|---|---|---|---|---|---|---|
| 4 | 6.6 | 19.6 | 0.669 | 0.018 | 3.8 | 5 | 19 | 4 | 16 |
| 5 | 6.9 | 20.4 | 0.655 | 0.041 | 2.5 | 15 | 32 | 5 | 20 |
| 6 | 6.9 | 22.2 | 0.697 | 0.000 | 5.8 | 8 | 16 | 4 | 14 |
| 7 | 6.9 | 18.5 | 0.598 | 0.026 | 7.2 | 9 | 12 | 4 | 11 |
| 8 | 6.4 | 21.8 | 0.685 | 0.015 | 3.6 | 5 | 12 | 3 | 13 |
| 9 | 6.6 | 20.0 | High dark decay | | | 5 | 19 | 8 | 26 |
| Ctrl | 10.0 | 21.9 | 0.675 | 0.038 | 3.9 | 22 | 48 | 26 | 87 |

Figure 2:
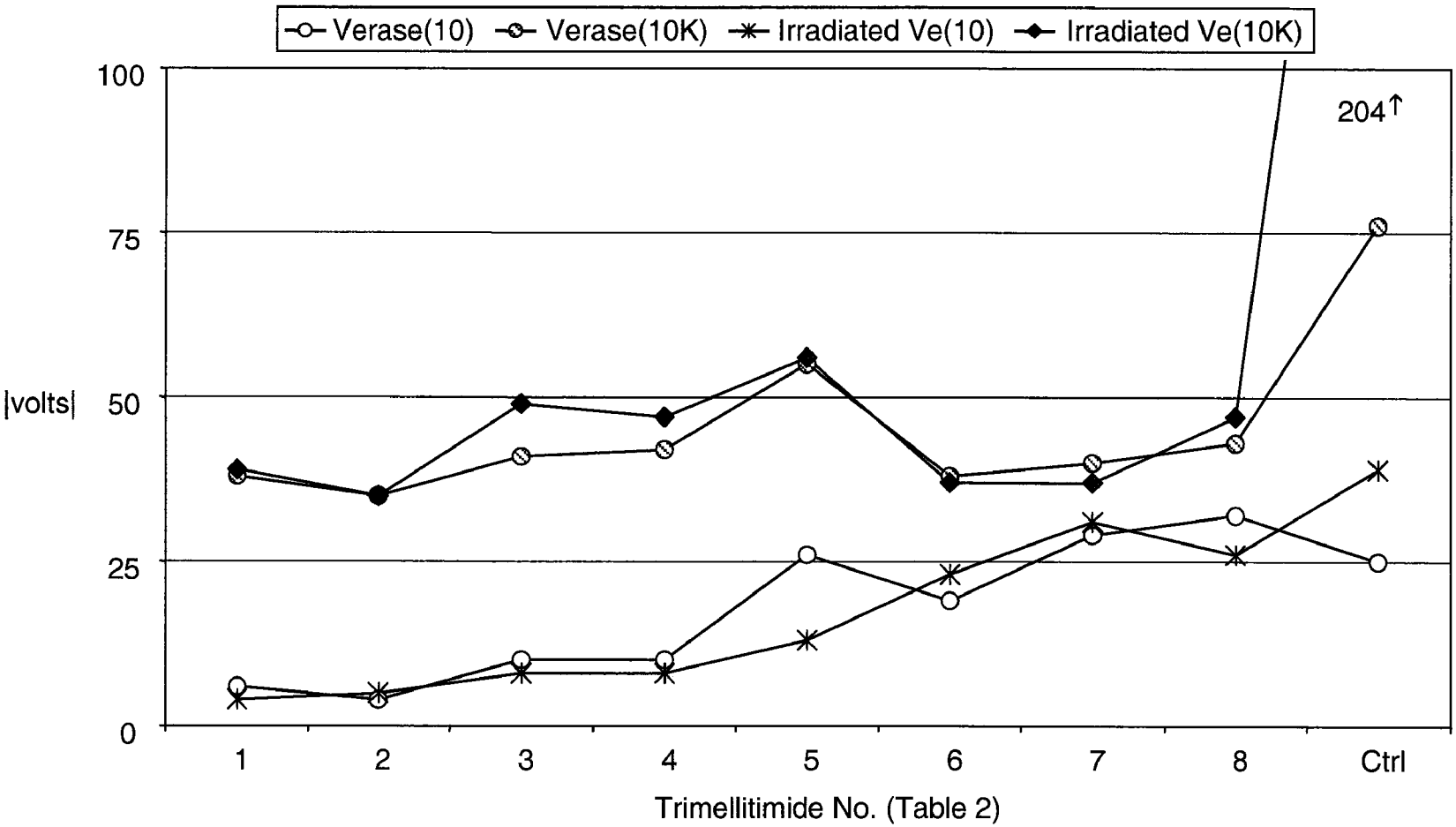
FIG. 2 shows 10,000 cycle Verase data for OPC films with a trimellitimide ester in the CTL.
Figure 3:
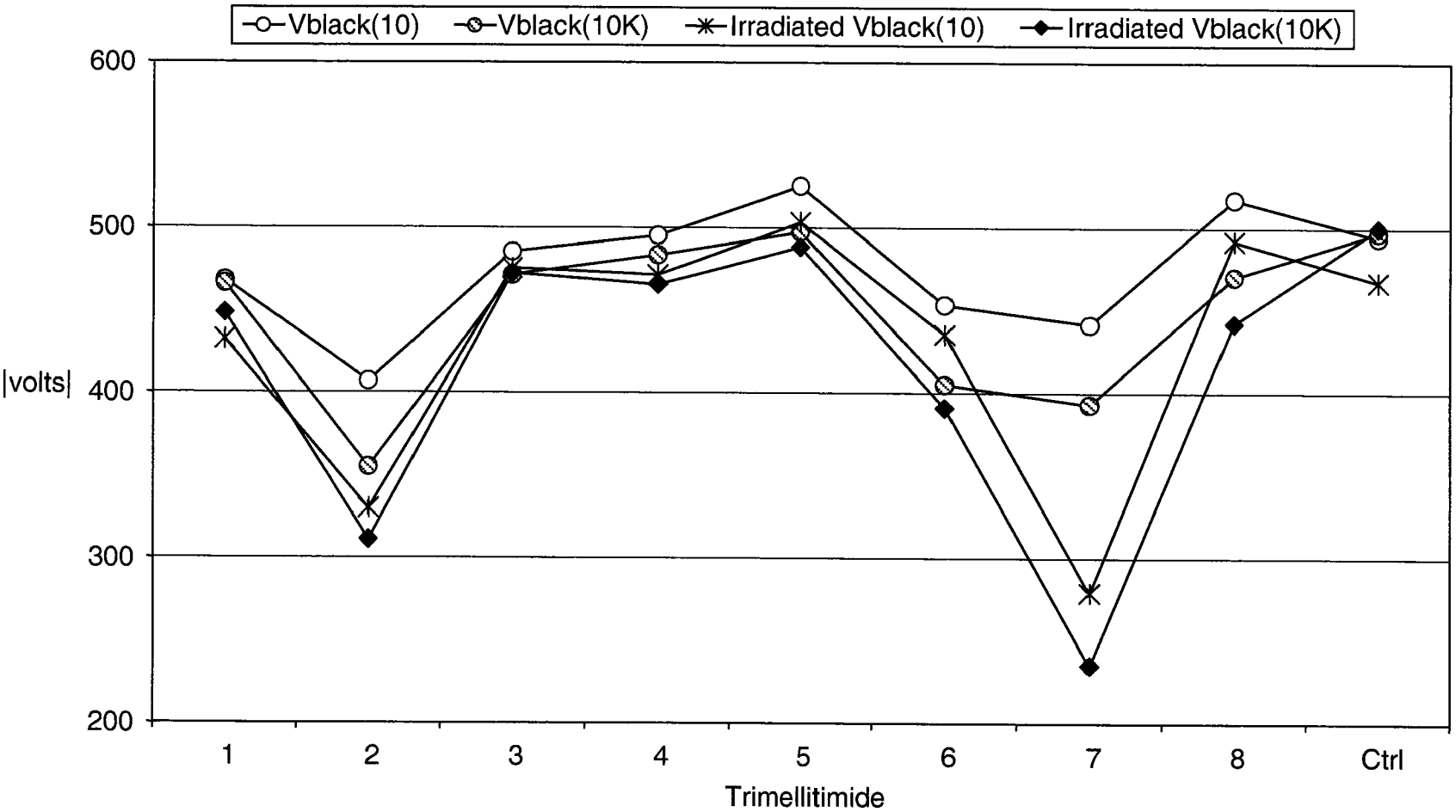
FIG. 3 shows 10,000 cycle Vblack data for OPC films with a trimellitimide ester in the CTL.

Voltage data are the absolute values of the actual negative voltages.
Ctrl = control coating containing 10 wt % poly{4,4'-nobornylidene bisphenylene terephthalate-co-azelate] as the photofatigue inhibitor
Wt % of CTL = Trimellitimide ester concentration as weight percent of CTL solids
CTL (μm) = Charge transport layer thickness in micrometers
b = photodischarge speed parameter described in U.S. Pat. No. 4,708,459
d = residual voltage parameter described in U.S. Pat. No. 4,708,459
DD = dark decay in volts/sec
Verase (1 cycle) = erase voltage for nonirradiated sample after 1 cycle on sensitometer
Verase (1K) = erase voltage for nonirradiated sample after 1,000 cycles
Irradiated Verase (1 cycle) = erase voltage for irradiated sample after 1 cycle
Irradiated Verase (1K) = erase voltage for irradiated sample after 1,000 cycles The data in Table 2 and FIG. 1 show that all nine trimellitimides exhibited better photofatigue inhibition than the control over 1,000 cycles. Films of trimellitimides 1-8 were then tested for 10,000 cycles. The film of compound 9 was not included because of high dark decay in the flash photodischarge test. The 10,000 cycle data are listed in Table 3 and graphed in FIGS. 2 and 3.

TABLE 3

10,000 Cycle photofatigue inhibition data

| Trimellitimide | Verase (10) | Verase (10K) | Irradiated Ve (10) | Irradiated Ve (10K) | Vblack (10) | Vblack (10K) | Irradiated Vblack (10) | Irradiated Vblack (10K) |
|---|---|---|---|---|---|---|---|---|
| 1 | 6 | 38 | 4 | 39 | 468 | 466 | 432 | 448 |
| 2 | 4 | 35 | 5 | 35 | 407 | 355 | 330 | 311 |
| 3 | 10 | 41 | 8 | 49 | 485 | 471 | 475 | 472 |
| 4 | 10 | 42 | 8 | 47 | 495 | 483 | 471 | 465 |
| 5 | 26 | 55 | 13 | 56 | 525 | 497 | 503 | 488 |
| 6 | 19 | 38 | 23 | 37 | 453 | 405 | 435 | 391 |
| 7 | 29 | 40 | 31 | 37 | 441 | 393 | 279 | 235 |
| 8 | 32 | 43 | 26 | 47 | 517 | 470 | 492 | 442 |
| Ctrl | 25 | 76 | 39 | 204 | 494 | 497 | 467 | 500 |

Data are the absolute values of the actual negative voltages.

Figure 4:
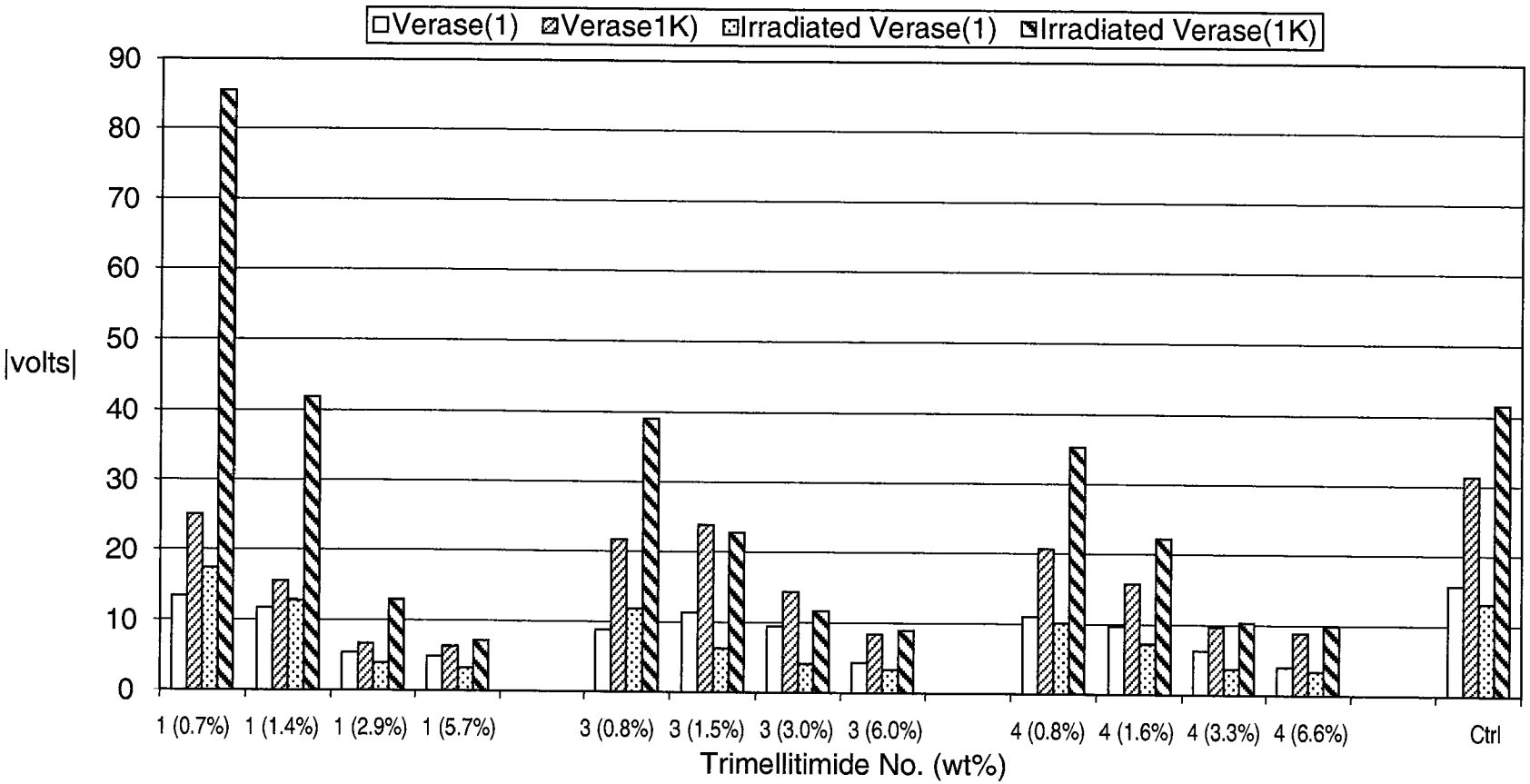
FIG. 4 shows 1,000 cycle photofatigue inhibition as a function of the concentration of trimellitimide ester in the CTL.

10K tests showed that meta-methyl 2 and diesters 6 & 7 exhibit Vblack instability. We tested the best ones at four concentrations. Table 4 and FIG. 4 provide summary of the data. There was not much effect on flash photodischarge. Photo fatigue inhibition improves as the concentration of trimellitimide increases. The upper limit of trimellitimide solubility is about 10 wt % in this formulation.

TABLE 4

Photodischarge and photofatigue inhibition data for concentration series

| Compound No. | Wt % of CTL | CTL (μm) | b | d | DD (v/sec) | Verase (1 cycle) | Verase (1K) | Irradiated Verase (1 cycle) | Irradiated Verase (1K) |
|---|---|---|---|---|---|---|---|---|---|
| 1 | 0.7 | 17.5 | 0.636 | 0.030 | 3.3 | 13 | 25 | 17 | 85 |
| 1 | 1.4 | 16.9 | 0.621 | 0.028 | 2.8 | 12 | 15 | 13 | 42 |
| 1 | 2.9 | 17.5 | 0.663 | 0.021 | 3.1 | 5 | 7 | 4 | 13 |
| 1 | 5.7 | 18.8 | 0.647 | 0.011 | 3.1 | 5 | 6 | 3 | 7 |
| 3 | 0.8 | 16.6 | 0.666 | 0.030 | 2.5 | 9 | 22 | 12 | 39 |
| 3 | 1.5 | 16.9 | 0.660 | 0.022 | 2.7 | 11 | 24 | 6 | 23 |

TABLE 4-continued

Photodischarge and photofatigue inhibition data for concentration series

| Compound No. | Wt % of CTL | CTL (μm) | b | d | DD (v/sec) | Verase (1 cycle) | Verase (1K) | Irradiated Verase (1 cycle) | Irradiated Verase (1K) |
|---|---|---|---|---|---|---|---|---|---|
| 3 | 3.0 | 17.5 | 0.644 | 0.019 | 2.8 | 9 | 14 | 4 | 12 |
| 3 | 6.0 | 18.8 | 0.655 | 0.009 | 2.8 | 4 | 8 | 3 | 9 |
| 4 | 0.8 | 18.4 | 0.639 | 0.022 | 2.5 | 11 | 21 | 10 | 35 |
| 4 | 1.6 | 16.3 | 0.651 | 0.024 | 2.7 | 10 | 16 | 7 | 22 |
| 4 | 3.3 | 17.8 | 0.661 | 0.016 | 2.7 | 6 | 10 | 4 | 10 |
| 4 | 6.6 | 17.5 | 0.664 | 0.007 | 2.9 | 4 | 9 | 3 | 10 |
| Ctrl | 10.0 | 15.6 | 0.631 | 0.032 | 2.1 | 16 | 31 | 13 | 41 |

Voltage data are the absolute values of the actual negative voltages.

Ctrl = control coating containing 10 wt % poly{4,4'-nobornylidene bisphenylene terephthalate-co-azelate} as the photofatigue inhibitor Wt % of CTL = Trimellitimide ester concentration as weight percent of CTL solids CTL (μm) = Charge transport layer thickness in micrometers b = photodischarge speed parameter as described in U.S. Pat. No. 4,708,459 d = residual voltage parameter as described in U.S. Pat. No. 4,708,459

DD = dark decay in volts/sec

Verase (1 cycle) = erase voltage for unfogged sample after 1 cycle on sensitometer Verase (1K) = erase voltage for unfogged sample after 1,000 cycles Irradiated Verase (1 cycle) = erase voltage for fogged sample after 1 cycle Irradiated Verase (1K) = erase voltage for fogged sample after 1,000 cycles The absorption of near UV or visible light by the charge transport material of an organic photoconductor may cause photofatigue. Adding 1-6% of a trimellitimide ester to the charge transport layer of an organic photoconductor reduces such light-induced photo fatigue.

The invention has been described in detail with particular reference to certain preferred embodiments thereof, but it will be understood that variations and modifications can be effected within the spirit and scope of the invention.

It is claimed:

1. An electrophotographic element comprising:

an electrically conductive support;

a charge-generation layer sensitive to visible or infrared radiation; and a charge-transport layer containing a charge-transport material, and an additive having the formula:

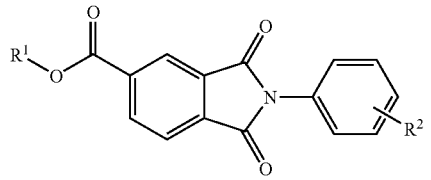

wherein $R^1$ is alkyl or aryl, $R^2$ is hydrogen, alkyl, alkoxy, aryloxy, aryl, halogen, cyano, carboxylic ester, acyl, perfluoroalkyl, or alkylsulfonyl.

2. The electrophotographic element of claim 1 wherein the charge transport layer comprises a polymeric binder of polycarbonate or polyester.

3. The electrophotographic element of claim 1 wherein the conductive support is selected from the group consisting of paper, aluminum-paper laminates, metal foils; metal plates and vapor deposited metal layers.

* * * * *